US005649980A

United States Patent [19]

Reinehr et al.

[11] Patent Number: 5,649,980

[45] Date of Patent: Jul. 22, 1997

[54] PROCESS FOR THE PHOTOCHEMICAL AND THERMAL STABILIZATION OF UNDYED AND DYED POLYESTER FIBRE MATERIALS

[75] Inventors: Dieter Reinehr, Kandern, Germany; Gerhard Reinert, Allschwil; Manfred Rembold, Aesch, both of Switzerland

[73] Assignee: Ciba-Geigy Corporation, Tarrytown, N.Y.

[21] Appl. No.: 538,059

[22] Filed: Oct. 2, 1995

Related U.S. Application Data

[63] Continuation of Ser. No. 338,290, Nov. 10, 1994, abandoned, which is a continuation of Ser. No. 106,102, Aug. 12, 1993, abandoned.

[30] Foreign Application Priority Data

Aug. 18, 1992 [CH] Switzerland ..... 2568/92

[51] Int. Cl.[6] ..... D06P 1/642

[52] U.S. Cl. ..... 8/566; 8/494; 8/587; 8/922

[58] Field of Search ..... 8/566, 587, 922, 8/494, 688

[56] References Cited

U.S. PATENT DOCUMENTS

| | | | |
|---|---|---|---|
| 3,270,016 | 8/1966 | Duennenberger et al. | 260/248 |
| 3,293,249 | 12/1966 | Biland et al. | 260/248 |
| 4,831,068 | 5/1989 | Reinert et al. | 8/566 |
| 4,886,518 | 12/1989 | Sire | 8/566 |
| 4,950,304 | 8/1990 | Reinert et al. | 8/566 |
| 5,084,570 | 1/1992 | Burdeska et al. | 544/216 |
| 5,106,972 | 4/1992 | Burdeska et al. | 544/219 |

*Primary Examiner*—Paul Lieberman
*Assistant Examiner*—Caroline L. Dusheck
*Attorney, Agent, or Firm*—Kevin T. Mansfield

[57] ABSTRACT

A process is described for the photochemical and thermal stabilisation of undyed and dyed polyester fibre materials, which comprises treating said materials with a compound of formula

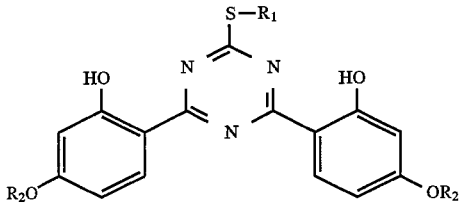

(1)

wherein $R_1$ and $R_2$ are each independently of the other $C_1$–$C_{12}$ alkyl. Dyeings and prints of superior lightfastness and sublimation fastness on polyester and cellulose acetate are obtained by this process.

5 Claims, No Drawings

PROCESS FOR THE PHOTOCHEMICAL AND THERMAL STABILIZATION OF UNDYED AND DYED POLYESTER FIBRE MATERIALS

This application is a continuation of application Ser. No. 08/338,290, filed Nov. 10, 1994, now abandoned; which is a continuation of application Ser. No. 08/106,102, filed Aug. 12, 1993, now abandoned.

The present invention relates to a process for the photochemical and thermal stabilisation of undyed and dyed polyester fibre materials.

Dyed or printed polyester fibre material can be damaged by the action of light, especially when simultaneously combined with the action of heat. For use in the automotive field, the provision of an effective protection of undyed and dyed fibre materials from UV radiation is indispensible.

Accordingly, the invention provides a process for the photochemical and thermal stabilisation of undyed and dyed polyester fibre materials, which comprises treating said materials with a compound of formula

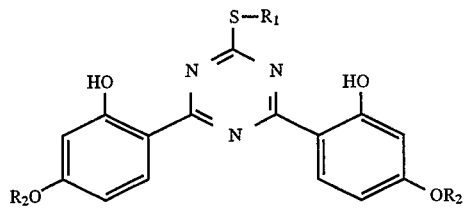

(1)

wherein $R_1$ and $R_2$ are each independently of the other $C_1$–$C_{12}$alkyl.

$C_1$–$C_{12}$Alkyl groups are straight-chain or branched alkyl radicals, typically methyl, ethyl, n-propyl, isopropyl, n-butyl, sec-butyl, tert-butyl, amyl, isoamyl or tert-amyl, heptyl, octyl, isooctyl, nonyl, undecyl or dodecyl.

Particularly interesting compounds of formula (1) are those wherein $R_1$ and $R_2$ are each independently of the other $C_1$–$C_5$alkyl. Particularly preferred compounds of formula (1) are those wherein $R_1$ and $R_2$ are methyl and those wherein $R_1$ is methyl and $R_2$ is propyl.

Illustrative examples of compounds of formula (1) are:

4,6-bis(2-hydroxy-4-methoxyphenyl)-2-methylthio-1,3,5-triazine 4,6-bis(2-hydroxy-4-methoxyphenyl)-2-ethylthio-1,3,5-triazine 4,6-bis(2-hydroxy-4-methoxyphenyl)-2-n-propylthio-1,3,5-triazine 4,6-bis(2-hydroxy-4-ethoxyphenyl)-2-ethylthio-1,3,5-triazine 4,6-bis(2-hydroxy-4-ethoxyphenyl)-2-methylthio-1,3,5-triazine 4,6-bis(2-hydroxy-4-ethoxyphenyl)-2-n-propylthio-1,3,5-triazine 4,6-bis(2-hydroxy-4-n-propoxyphenyl)-2-methylthio-1,3,5-triazine 4,6-bis(2-hydroxy-4-n-propoxyphenyl)-2-ethylthio-1,3,5-triazine 4,6-bis(2-hydroxy-4-n-propoxyphenyl)-2-n-propylthio- 1,3,5-triazine The compounds of formula (1) are known, inter alia from CH-436 285. They may be prepared in general accordance with the process disclosed in EP-A-0 395 938 by Friedel-Crafts alkylation of 1 mol of cyanuric chloride with 1 mol of an alkylmercaptan and with 2 mol of the corresponding benzenoid compound in the presence of a Lewis acid, preferably aluminium chloride.

The UV absorbers of this invention are used in an amount of 0.01 to 10% by weight, preferably of 0.01 to 5% by weight, based on the weight of the fibre material.

The UV absorbers of this invention are sparingly soluble in water and therefore applied in dispersed form. To this end they are milled with an appropriate dispersant, conveniently using quartz balls and an impeller, to a particle size of 1–2 μm.

Suitable dispersants for the UV absorbers of formula (1) are:

acid esters or their salts of alkylene oxide adducts, typically acid esters or their salts of a polyadduct of 4 to 40 mol of ethylene oxide with 1 mol of a phenol, or phosphated polyadducts of 6 to 30 mol of ethylene oxide with 1 mol of 4-nonylphenol, 1 mol of dinonylphenol or, preferably, with 1 mol of compounds which are prepared by addition of 1 to 3 mol of unsubstituted or substituted styrenes to 1 mol of phenol, polystyrene sulfonates, fatty acid taurides, alkylated diphenyl oxide mono- or disulfonates, sulfonates of polycarboxylates, the polyadducts of 1 to 60 mol of ethylene oxide and/or propylene oxide with fatty amines, fatty acids or fatty alcohols, each containing 8 to 22 carbon atoms in the alkyl chain, with alkylphenols containing 4 to 16 carbon atoms in the alkyl chain, or with trihydric to hexahydric alkanols containing 3 to 6 carbon atoms, which polyadducts are converted into an acid ester with an organic dicarboxylic acid or with an inorganic polybasic acid, ligninsulfonates, and, most preferably, formaldehyde condensates such as condensates of ligninsulfonates and/or phenol and formaldehyde, condensates of formaldehyde with aromatic sulfonic acids, typically condensates of ditolyl ether sulfonates and formaldehyde, condensates of naphthalenesulfonic acid and/or naphthol- or naphthylaminesulfonic acids with formaldehyde, condensates of phenolsulfonic acids and/or sulfonated dihydroxydiphenylsulfone and phenols or cresols with formaldehyde and/or urea, as well as condensates of diphenyl oxide-disulfonic acid derivatives with formaldehyde.

Suitable dyes are disperse dyes which are only sparingly soluble in water. They are therefore substantially present in the dye liquor in the form of a fine dispersion. They may belong to different dye classes, including acridone, azo, anthraquinone, coumarin, methine, perinone, naphthoquinone-imine, quinophthalone, styryl or nitro dyes. Mixtures of disperse dyes may also be used in the practice of this invention.

Polyester fibre material which can be dyed or printed and treated with the cited UV absorbers will be understood as including cellulose ester fibres such as cellulose secondary acetate and cellulose triacetate fibres and, preferably, linear polyester fibres which may also be acid-modified, and which are obtained by the condensation of terephthalic acid with ethylene glycol or of isophthalic acid or terephthalic acid with 1,4-bis(hydroxymethyl)cyclohexane, as well as copolymers of terephthalic and isophthalic acid and ethylene glycol. The linear polyester fibre material (PES) hitherto used almost exclusively in the textile industry consists of terephthalic acid and ethylene glycol.

The fibre materials may also be used as blends with each other or with other fibres, typically blends of polyacrylonitrile/polyester, polyamide/polyester, polyester/cotton, polyester/viscose and polyester/wool, and they can be dyed or also printed batchwise or continuously.

The textile material can be in different forms of presentation, preferably as piece goods such as knitgoods or wovens or also as yarn on cheeses, warp beams and the like.

Also very suitable for dyeing by the process of this invention are textile fabrics in the outerwear garment sector that are light-permeable. Textiles treated by the inventive process are able to protect the sensitive skin tissue beneath the transparent outerwear fabric from the harmful action of UV radiation.

Dyeing is carried out from an aqueous liquor by a continuous or batch process. In batchwise dyeing, the liquor ratio may be chosen over a wide range, typically from 1:4 to 1:100, preferably from 1:6 to 1:50. The dyeing temperature is not lower than 50° C. and is normally not higher than 140° C. The preferred temperature range is from 80° to 135° C.

In continuous dyeing methods, the dye liquors, which may optionally contain assistants in addition to the dyes, are applied to the piece goods for example by padding or slop-padding and developed by thermofixation or HT steaming processes.

Linear polyester fibres and cellulose fibres are preferably dyed by the high temperature process in closed and pressure-resistant apparatus at temperatures of >100° C., preferably in the range from 110° to 135° C., and at normal or elevated pressure. Suitable closed apparatus includes typically circulation dyeing machines such as cheese or beam dyeing machines, winch becks, jet or drum dyeing machines, muff dyeing machines, paddles or jiggers.

Cellulose secondary acetate is preferably dyed in the temperature range from 80°–85° C.

When using the UV absorbers of this invention for dye application, the procedure is such that the fibre material is first treated with these compounds and then dyeing is carried out or, preferably, the fibre material is treated simultaneously in the dyebath with the UV absorber and the dye. The application of the UV absorber can, however, also be made subsequently to the ready prepared dyeing by thermofixation, conveniently at 190°–230° C. over a period of 30 seconds to 5 minutes.

The dye liquors may also contain further ingredients such as dyeing assistants, dispersants, carriers, wool protectives, and wetting agents as well as antifoams.

The dyebaths may also contain mineral acids, typically sulfuric acid or phosphoric acid, or conveniently organic acids, typically including aliphatic carboxylic acids such as formic acid, acetic acid, oxalic acid or citric acid and/or salts such as ammonium acetate, ammonium sulfate or sodium acetate. The acids are used in particular to adjust the pH of the liquors used in the practice of this invention to 4–5.

Preferably the fibre material is first run in the bath which contains the dye, the UV absorber and any further auxiliaries and which has been adjusted to pH 4.5–5.5 at 40°–80° C., then the temperature is raised to 125°–130° C. over 10 to 20 minutes, and further treatment is carried out for 15 to 90 minutes, preferably for 30 minutes, at this temperature.

The dyeings are finished by cooling the dye liquor to 50°–80° C., washing off the dyeings with water and, if necessary, reduction clearing them in conventional manner in alkaline medium. The dyeings are then again washed off and dried. When using vat dyes for dyeing the cellulose component, the goods are first treated with hydrosulfite at pH 6–12.5, then treated with an oxidising agent and finally washed off.

For producing prints, the UV absorbers of this invention are mixed in the form of aqueous dispersions with the print pastes. The print paste then contains the UV absorber in an amount of 0.1 to 10%, preferably 0.1 to 5%, based on the weight of the print paste.

The amount of dye added to the print pastes will depend on the desired shade. Normally amounts of 0.01 to 15% by weight, preferably of 0.02 to 10% by weight, based on the textile material, have been found useful.

In addition to the dyes and the aqueous dispersion of the UV absorber, the print pastes conveniently contain acid-stable thickeners, preferably those of natural origin such as carob bean flour derivatives, especially sodium alginate by itself or in admixture with modified cellulose, preferably with 20 to 25% by weight of carboxymethyl cellulose. If desired, the print pastes may further contain acid donors such as butyrolactone or sodium hydrogen phosphate, preservatives, sequestering agents, emulsifiers, water-insoluble solvents, oxidising agents or deaerators.

Particularly suitable preservatives are formaldehyde donors such as paraformaldehyde or trioxane, preferably c. 30 to 40% by weight aqueous formaldehyde solutions. Suitable sequestering agents are sodium nitrilotriacetate, sodium ethylenediaminetetraacetate, preferably sodium polymethaphosphate, more particularly sodium hexamethaphosphate. Emulsifiers are preferably polyadducts of an alkylene oxide and a fatty alcohol, more particularly a polyadduct of oleyl alcohol and ethylene oxide. Water-insoluble solvents are preferably high-boiling saturated hydrocarbons, more particularly paraffins having a boiling range from about 160° to 210° C. (white spirits). Oxidising agents are typically aromatic nitro compounds, preferably an aromatic mono- or dinitrocarboxylic acid or mono- or dinitrosulfonic acid which may be in the form of an alkylene oxide polyadduct, preferably a nitrobenzenesulfonic acid. Deaerators are suitably high-boiling solvents, preferably terpentine oils, higher alcohols, $C_8$–$C_{10}$alcohols, terpene alcohols or deaerators based on mineral and/or silicone oils, preferably commercial formulations comprising about 15–25% by weight of a mixture of mineral and silicone oils and about 75–85% by weight of a $C_8$alcohol such as 2-ethyl-n-hexanol.

For printing the fibre materials, the print paste is applied direct to the whole or to a part of the surface, conveniently using printing machines of conventional construction, typically rotogravure, rotary screen printing and flat screen printing machines.

The fibre material is dried after printing in the temperature range up to 150° C., preferably in the range from 80° to 120° C.

The subsequent fixation of the fibre material is usually carried out by a heat treatment, preferably in the temperature range from 100° to 220° . The heat treatment is normally carried out with superheated steam under atmospheric pressure.

Depending on the temperature, fixation is carried out for 20 seconds to 10 minutes, preferably for 4 to 8 minutes.

The prints are also finished in conventional manner by washing off with water, followed by an optional reductive afterclear in alkaline medium, conveniently with sodium dithionite. In this last mentioned case, the prints are again washed off, hydroextracted and dried.

The process of this invention makes it possible to obtain dyeings and prints of superior lightfastness and sublimation fastness on polyester material. A systematic pre- or after-treatment of the fibre material is not necessary in the inventive process.

In the following use Examples, percentages are by weight. The amounts of dye and UV absorber are based on pure substance.

Example 1

Use in dyeing

Three PES tricot samples of 10 g each are dyed in a HT dyeing machine, e.g. ®Labomat (supplied by Mathis, Niederhasli) at a liquor ratio of 1:10. Three liquors are prepared containing 2 g/l of ammonium sulfate, 0.5 g/l of a dyeing assistant ®Univadin 3-flex and the dyes of formulae (1) to (4) in the following amounts: 0.210% of the dye of formula

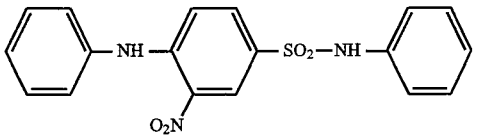

(1)

0.087% of the dye of formula

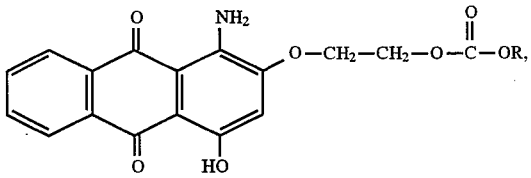

(2)

R = 50% $-CH_2CH_2$

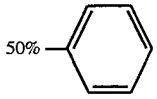

0.80% of the dye of formula

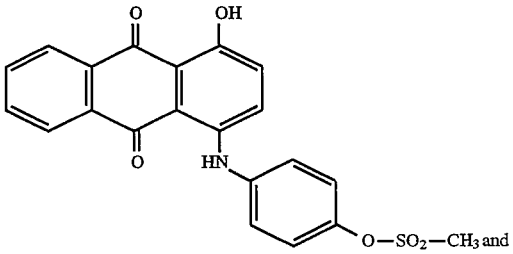

(3)

0.087% of the dye of formula

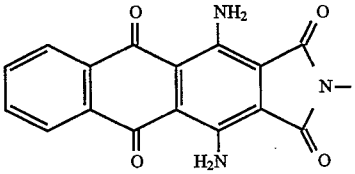

(4)

$-(CH_2)_3-OCH_3$ (142 parts)
$-(CH_2)_3-O(CH)_2OCH_3$ (58 parts).

Whereas liquor (I) contains no further ingredients, 0.6% of compound

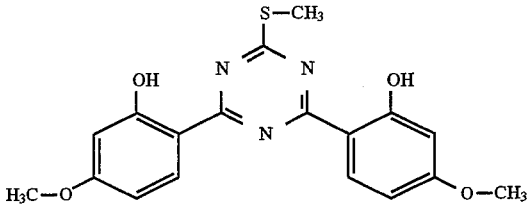

(101)

is added to liquor (II), and 0.6% of compound

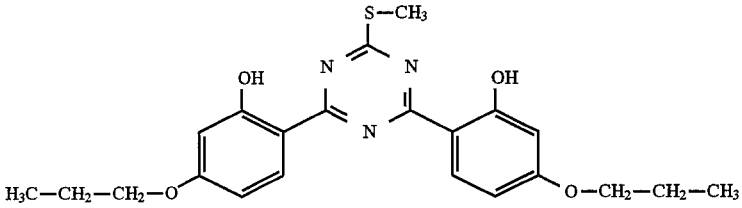

(102)

is added to liquor (III).

The UV absorbers are formulated before addition to the dye liquor or to the print paste. This is done by milling the respective compounds, the naphthalenesulfonic acid/formaldehyde condensate used as dispersant in the ratio 1:1, the 2–4-fold amount of water, and the 4-fold amount of quartz balls (Ø1 mm)

with an impeller until the product has a particle size of 1–2 μm. The dispersion is separated with a fine mesh sieve and stabilised with 0.5% of carboxymethyl cellulose and adjusted to 30%.

The tricot samples are dyed in the dispersed liquors in pressure bombs. The samples are put into the liquors at 50° C. and, after a treatment time of 5 minutes at 3° C./min, heated to 130° C. Dyeing is carried out for 45 minutes at this temperature and then, after cooling to 50° C., the dyed samples are rinsed with warm and cold water and dried.

The lightfastness properties are determined by irradiating the dyeings in accordance with DIN 75.202 (FAKRA) and SAE J 1885. The results are reported in Table 1.

TABLE 1

| Dyeing (liquor) | Colour difference factor ΔE FAKRA 260 hours | 488 KJ SAE J 1885 |
|---|---|---|
| (I) no addition | 4.25 | 7.25 |
| (II) +0.6% of compound (101) | 1.8 | 3.5 |
| (III) +0.6% of compound (102) | 1.7 | 3.4 |

Example 2

Use for printing

Print pastes of the following composition are used for printing PES automobile upholstery:

750 parts of a stock thickening comprising 9 parts of starch ether as thickener
18 parts of sodium alginate as thickener
3.75 parts of sodium dihydrogen phosphate
2.48 parts of sodium chlorate and
716.77 parts of water.

This stock thickening is mixed with 6.4 parts of the dye mixture consisting of
2.0 parts of the dye of formula (4)
1.4 pans of the dye of formula (5)

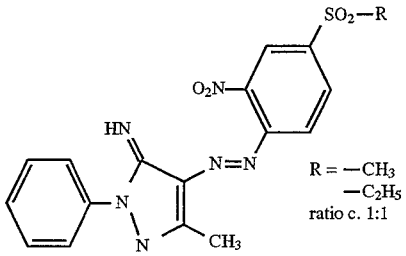

| | |
|---|---|
| 2.0 | parts of the dye formula (2) and |
| 1.0 | part of the dye of formula (3) |
| 243.6 | parts of water (= print paste A) |
| 213.6 | parts of water (= print paste B) and |
| 0 | part of UV absorber (= print paste A) |
| 30 | of the dispersed 30% UV absorber formulation of formula (101) according to Example 1 (= print paste B). |

Two pre-cleaned PES tricot samples are printed with print pastes A and B on a Zimmer printing table (supplied by Zimmer, Klagenfurt/Austria). These samples are dried and steamed with superheated steam at 180° C. for 8 minutes. The samples are then rinsed with cold water and given a reductive afterclear at 70° C. for 30 minutes in baths containing 2 ml/l of aqueous sodium hydroxide of 36° Bé and 3 g/l of sodium dithionite. The samples are rinsed with warm and cold water, centrifuged and dried at 100° C. They are then tested for their lightfastness properties in accordance with DIN 75.202 (FAKRA), and according to SAE J 1885 (SAE). The results are reported in Table 2.

TABLE 2

| | Lightfastness properties after | | |
|---|---|---|---|
| Prints | FAKRA 288 hours | SAE 489 KJ | SAE 489 KJ |
| no UV absorber | 2 | 1–2 | 1–2 |
| +compound (101) | 4 | 4 | 3–4 |

The results reported in Table 2 show that the UV absorber of formula (101) effects a marked enhancement of the hot lightfastness properties.

What is claimed is:

1. A process for the photochemical and thermal stabilization of undyed polyester fibre materials, which comprises treating said materials with an effective amount of a compound of the formula (1)

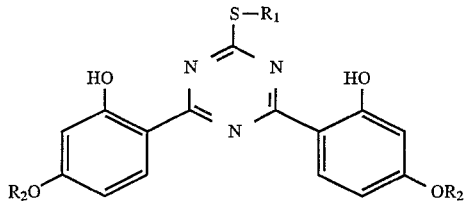

wherein $R_1$ and $R_2$ are each independently of the other $C_1$–$C_5$alkyl in the temperature range from 80° to 135° C. and a pH range from 4.5 to 5.5 and wherein the compound of formula (1) is added directly to an aqueous exhaust dye liquor or to an aqueous padding dye liquor.

2. A process according to claim 1, wherein $R_1$ and $R_2$ are methyl.

3. A process according to claim 1, wherein $R_1$ is methyl and $R_2$ is propyl.

4. A process according to claim 1, wherein the compound of formula (1) is added in an mount of 0.01 to 10% by weight, based on the fibre material.

5. The fibre material treated by a process as claimed in claim 1.

* * * * *